US012529498B1

(12) United States Patent
Mora-Torres

(10) Patent No.: US 12,529,498 B1
(45) Date of Patent: Jan. 20, 2026

(54) EXTERNAL DRAIN PAN WATER REMOVAL SYSTEM

(71) Applicant: Mario Mora-Torres, Oviedo, FL (US)

(72) Inventor: Mario Mora-Torres, Oviedo, FL (US)

( * ) Notice: Subject to any disclaimer, the term of this patent is extended or adjusted under 35 U.S.C. 154(b) by 0 days.

(21) Appl. No.: 18/984,641

(22) Filed: Dec. 17, 2024

(51) Int. Cl.
*F24F 13/22* (2006.01)

(52) U.S. Cl.
CPC ..... *F24F 13/222* (2013.01)

(58) Field of Classification Search
CPC ..... F24F 13/22; F24F 13/222; F24F 2013/227
See application file for complete search history.

(56) References Cited

U.S. PATENT DOCUMENTS 4,998,412 A * 3/1991 Bell ..... F24F 13/22 138/92
6,322,326 B1 * 11/2001 Davis ..... F24F 13/222 417/279
6,895,770 B1 * 5/2005 Kaminski ..... F24F 13/222 62/285
8,151,580 B1 * 4/2012 Cantolino ..... H01H 29/04 62/150
2008/0142525 A1 * 6/2008 Brouillette ..... F24F 13/222 220/571

FOREIGN PATENT DOCUMENTS

JP S6425656 U * 2/1989
KR 20020044795 A * 6/2002 ..... F24F 13/222
KR 20130098706 A * 9/2013 ..... F24F 13/20
KR 101582921 B1 * 1/2016 ..... F24F 13/22

* cited by examiner

*Primary Examiner* — Tavia Sullens
(74) *Attorney, Agent, or Firm* — Jason T. Daniel, Esq.; Daniel Law Offices, P.A.

(57) ABSTRACT

An external drain pan water removal system includes a drain pan that is positionable beneath an attic-mounted air handler for capturing water overflowing from the air handler. A pump assembly is positioned within the drain pan and includes a main body that houses an electric water pump and a float switch. A drain line coupler connects to the condensate drain of the air handler, and an elongated hose connects the pump assembly to the drain line coupler. An overflow detection switch is located within the pump assembly. The overflow switch and pump are each connected to the auxiliary panel of the air handler. The pump is selectively activated by the float switch based on the water level in the pan, and the overflow switch instructs the auxiliary panel to disable the air handler upon detecting the water level of the pan has exceeded a predetermined threshold.

15 Claims, 4 Drawing Sheets

EXTERNAL DRAIN PAN WATER REMOVAL SYSTEM

TECHNICAL FIELD

The present invention relates generally to residential HVAC systems, and more particularly to a water removal system for use with external drain pans on attic-mounted air handling units.

BACKGROUND

The statements in this section merely provide background information related to the present disclosure and may not constitute prior art.

As shown in background FIG. 1, residential HVAC systems include an air handler 1 having an internal blower 2 that passes air over a series of evaporator coils 3. During operation of the air handler, condensation is formed on the coils and is routed into an internal drain pain 4 located beneath the coils inside the main body of the air handler unit. The internal pan is designed to funnel the liquid into a condensate drain line 5 for removal to a location outside the building.

Condensate drain lines typically include a removeable cleanout cap 5*a* that is located at a tee junction 5*b* adjacent to where the internal pan meets the drain line. The tee junction is where the drain line changes from a horizontal position to a vertical position and is also the location where clogs C from algae, fungus and various airborne debris collected by the air handler forms. When the condensate drain line becomes clogged, water in the internal drain pan will continue to rise until it overflows from the pan and leaks out of the bottom of the unit.

For this reason, it is not uncommon for residents or HVAC installers to place a large pan beneath air handling units that are mounted in attics or on second stories of residences to prevent damage to the ceiling panels of lower floors by attempting to contain small leaks emanating from the air handler.

Unfortunately, residents typically do not know their unit is leaking until the water overflows the unit 1 and/or the external pan and causes damage to the surrounding structure. When this occurs, the resident must often wait several days for a technician to arrive to inspect the unit, manually remove the water from the external drain pan, and fix the underlying issue—often a clog in the drain line—that caused the overflow situation. In tropical climates, this delay can be unbearable to the residents who must go without air conditioning. Additionally, during this time mold and algae grow throughout the system, which results in additional repair and cleaning expenses.

Accordingly, it would be beneficial to provide an automated water removal system that can be connected to a new or existing external drain pan that eliminates the drawbacks noted above.

SUMMARY OF THE INVENTION

The present invention is directed to an external drain pan water removal system. One embodiment of the present invention can include a drain pan that is configured to be positioned beneath an attic-mounted air handling unit of a building. The drain pan is larger than the main body of the air handling unit and includes a plurality of sidewalls for capturing and storing water that escapes the air handling unit in an overflow situation.

In one embodiment, a pump assembly is positioned within the drain pan. The pump assembly can include a main body that houses an electric water pump and a float switch. The water pump can be connected to the auxiliary panel of the air handling unit to receive power. A drain line coupler can be connected to the condensate drain line of the air handling unit at a location beneath the primary tee junction that connects the internal drain pan of the air handling unit to the condensate line. An elongated hose can connect the pump assembly to the drain line coupler.

In one embodiment, an overflow detection switch is located within the pump assembly. The overflow detection switch can be connected to the auxiliary panel of the air handling unit and can instruct the panel to disable the air handling unit upon detecting water within the pan is above a predetermined threshold.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

Figure 1:
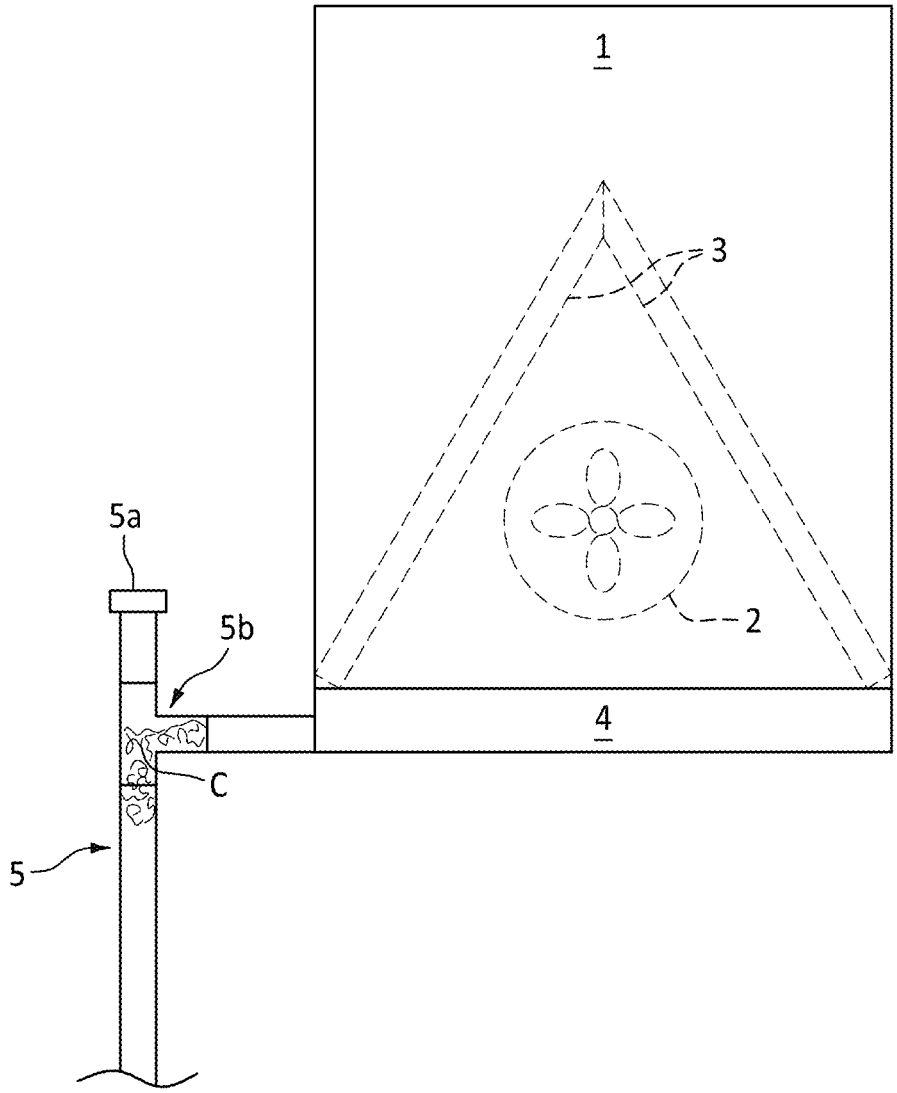
FIG. 1 (Background Art)
FIG. 1 is a perspective view of an air handling unit and condensate drain line in accordance with background art.
Figure 2:
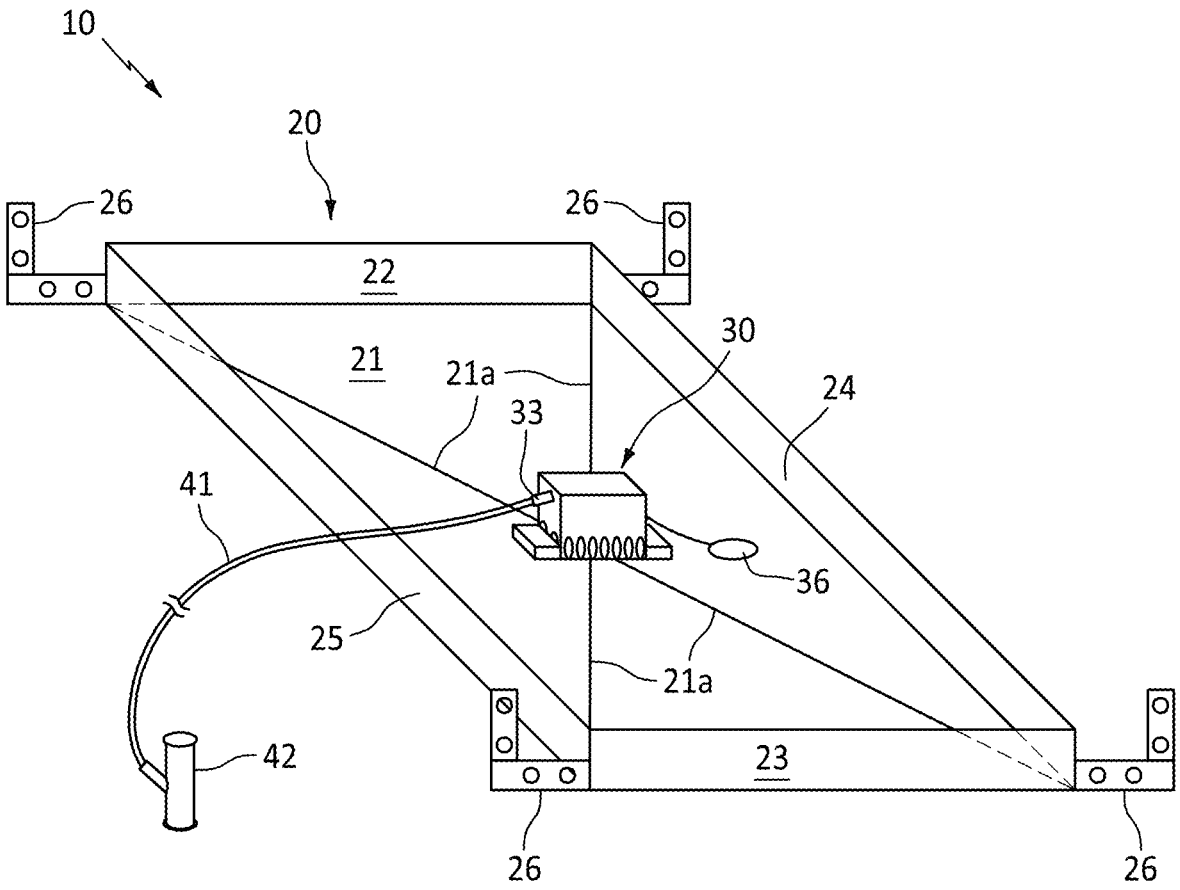
FIG. 2 is a perspective view of the external drain pan water removal system, in accordance with one embodiment of the invention.
Figure 3:
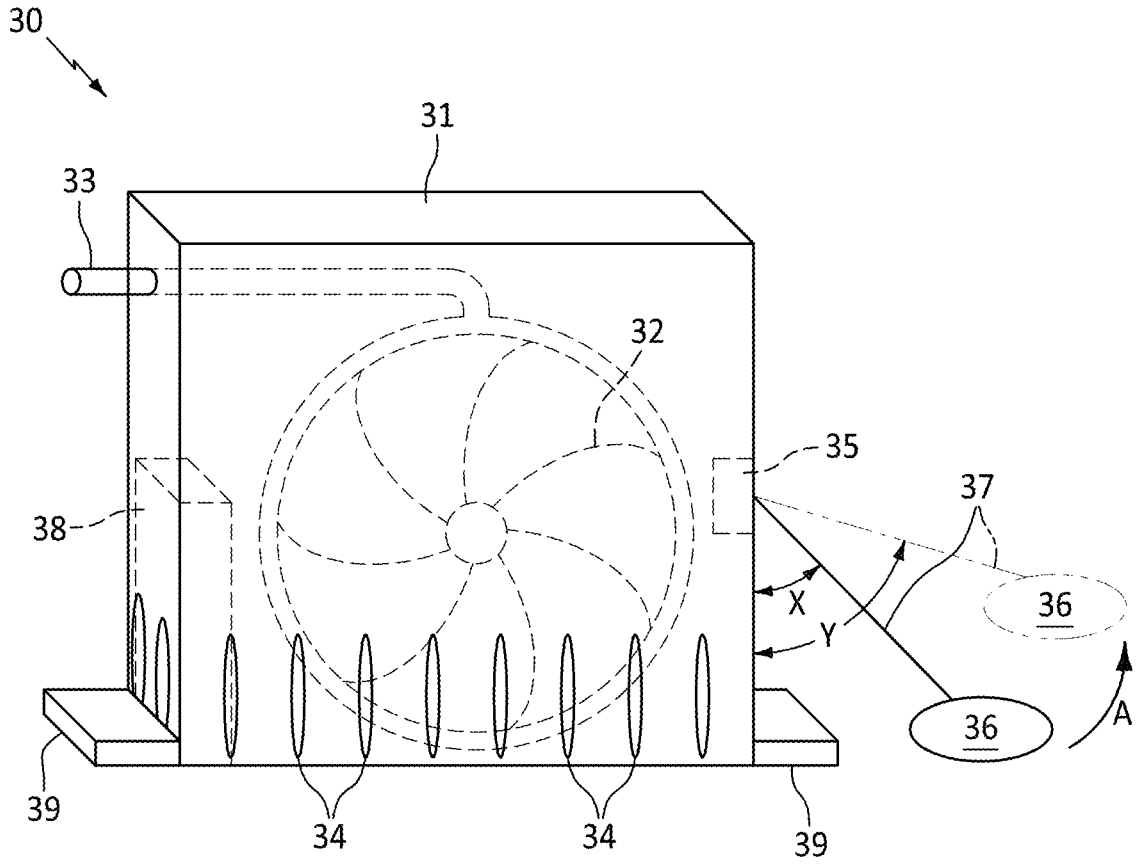
FIG. 3 is a perspective view of the pump assembly of the external drain pan water removal system, in accordance with one embodiment of the invention.
Figure 4:
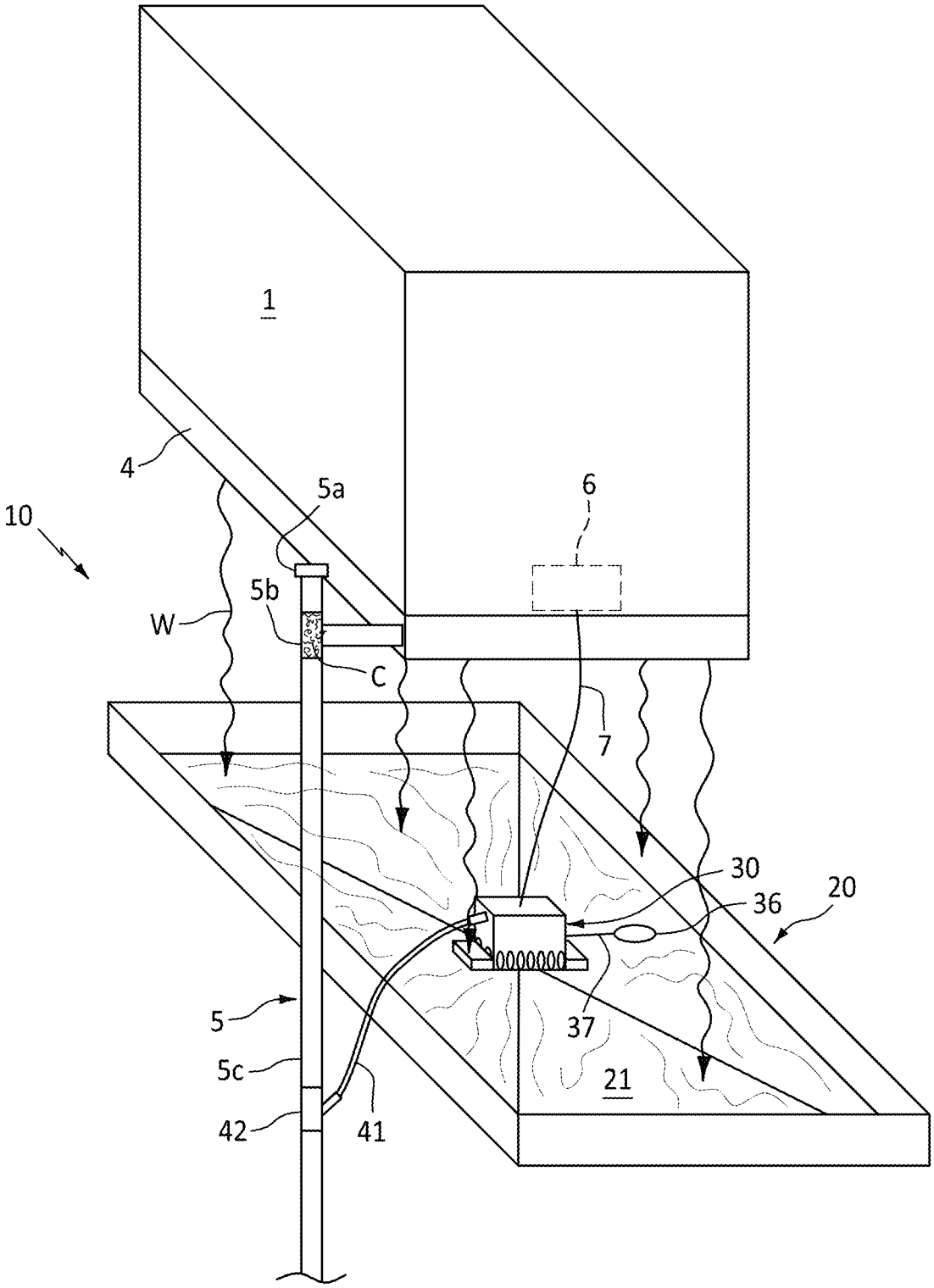
FIG. 4 is a perspective view of the external drain pan water removal system in operation, in accordance with one embodiment of the invention.

FIGS. 2-4 illustrate one embodiment of an external drain system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," "beneath," and derivatives thereof shall relate to the invention as oriented in FIG. 4.

As shown best at FIG. 2, the system 10 can include an external condensate drain pan 20, a pump assembly 30, a drain hose 41 and a condensate drain line coupler 42.

In one embodiment, the external condensate drain pan 20 can include an elongated member having a bottom wall 21, and a plurality of sidewalls 22, 23, 24 and 25 extending upward therefrom. In the preferred embodiment, the pan 20 will be constructed for use with a particular type or brand of air handler 1 and will include a shape and size that is complementary to or greater than the cross dimensional shape and size of the air handler main body. Such a feature is important to allow the pan to capture water and other fluids leaking from the bottom of the air handler in an overflow situation caused by a clog in the condensate drain line, or other such reasons, for example.

In one embodiment, the bottom wall 21 can include an angular surface 21*a* that directs liquids to a specific location on the pan, such as the center section, for example, where the below described pump assembly 30 is located. Additionally, any number of brackets 26 may be provided for physically securing the pan onto one or both of the bottom of the air handling unit, or rafters in an attic space.

In either instance, the pan 20 will preferably include the illustrated rectangular-shaped member and will be constructed from a lightweight rigid material such as galvanized steel, for example, so as to be structurally solid to hold several gallons of water without deforming and remaining resistant to rust and corrosion. Of course, other embodiments are contemplated wherein the pan is constructed from other materials such as various plastics or composite materials, for example, and/or includes a different shape.

Additionally, although described as a system component in one embodiment, other embodiments are contemplated wherein the below described pump assembly 30 and drain elements are utilized with a different pan of an existing air handling unit.

The pump assembly 30 can function to detect the presence of water within the pan 20 and to remove the same. As shown best at FIG. 3, one embodiment of the pump assembly can include a main body 31 having an electric pump 32 that is connected to a hose fitting 33. In the preferred embodiment, the pump will comprise a 24v electric pump that can be connected to the auxiliary panel 6 of the air handler 1 via control and power wires 7 (See FIG. 4) so as to receive power therefrom. The pump includes a motor and impeller that expel water that enters the main body via openings 34.

In one embodiment, an electric switch 35 is positioned within the main body and is connected to a float 36 via an actuator arm 37. As shown by arrow A, the float 36 is operably connected to the switch 35 such that movement of the float between a first position X and a second position Y activates the switch, which in turn activates the pump 32. In this regard, when no water is present within the tray 20, the switch will be in the first position A and the pump will be Off. Conversely, when water is present in the tray sufficient to lift the float about ¼ of an inch, for example, the switch will activate the pump.

In one embodiment, a separate overflow detection switch 38 can be provided within the main body 31. The overflow detection switch will preferably comprise a solid-state liquid detection switch and can also be electrically connected to the auxiliary controller of the air handler 1. The switch 38 functioning as a failsafe for the system 10 and can send a signal to the auxiliary controller of the air handler unit 1 to disable the operation of the air handler upon detecting that water within the pan 20 has reached a predetermined maximum level such as 1 inch, for example.

In addition to the above, the overflow detection switch 38 can also be connected directly to the pump 32 and can selectively activate the pump upon detecting the presence of any amount of water. In this regard, the switch 38 functions as a backup to the primary float switch 35 in the event that sensor fails, and as an emergency system cutoff in the event the pump 32 fails.

In one embodiment, a pair magnets 39 can be provided along the main body 31. The magnets can be magnetically attracted to the pan 20 in order to secure the assembly thereto when the system is installed. Although illustrated with regard to magnets for securing the assembly onto a metallic pan, other embodiments are contemplated wherein any number of other types of connectors capable of securing the assembly onto any type of pan in either a permanent or removable manner are also contemplated.

As shown at FIG. 4, a drain hose 41 can connect the pump assembly 30 to the condensate drain line 5 via a drain line coupler 42. In one embodiment, the drain hose 41 can include a ½ inch diameter flexible plastic tube having a length of about 3 feet; however, any number of other lengths, diameters, and construction materials suitable for discharging water from the pump assembly to the drain line also contemplated.

In the illustrated embodiment, the drain line coupler 42 can include, comprise, or consist of a PVC tee fitting in the same size—e.g., ¾ inch—as the condensate drain line. The coupler 42 can be connected to the drain line at a location 5*c* downstream/beneath the primary tee juncture 5*b* where the line meets the air handler 1. In this regard, the system 10 advantageously pumps water W that leaks from the air handler 1 into the external pan 20 into the condensate drain line 5 at a location beyond where clogs C within the line form. Such a feature is important, as this allows the air handler to continue running and for all water generated by the air handling unit to be evacuated from the building by the condensate drain line even if there is a clog in the line 5 itself.

Although described above with regard to a tee fitting, this is for illustrative purposes only. To this end, the drain line connector can include any number of different components capable of engaging the condensate drain line of an air handler at any location in order to permit water from the pump assembly to be supplied thereto.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A system, comprising:

a drain pan that is configured to be positioned beneath a main body of an air handling unit having an internal drain pan that is connected to a condensate drain line at a primary juncture;

a pump assembly that is positioned within the drain pan, said pump assembly including a main body, an electric water pump, a primary overflow detection switch, and a secondary overflow detection switch; and a drain hose having a first end that is connected to the pump assembly, and a second end having a coupler that is configured to be connected to the condensate drain line at a location downstream from the primary juncture, wherein the drain pan is configured to capture water overflowing from the air handling unit, wherein the pump assembly is configured to move the captured water from the drain pan into the drain hose, and wherein the drain hose and coupler are configured to direct the captured water into the condensate drain line at the location downstream of the primary juncture.

2. The system of claim 1, wherein the coupler includes a tee fitting having a first end and a second end that are each connected to the condensate drain line, and a third end that is connected to the second end of the drain hose.

3. The system of claim 1, wherein the pump assembly main body includes a plurality of sidewalls that define an interior space, and a plurality of apertures along at least one of the plurality of sidewalls.

4. The system of claim 1, wherein the drain hose comprises an elongated flexible tube.

5. The system of claim 1, further comprising:

a plurality of brackets for securing the drain pan beneath the air handling unit.

6. The system of claim 5, wherein the drain pan includes a shape and a size that is complementary to a shape and a size of the air handling unit.

7. The system of claim 1, wherein the primary overflow detection switch is configured to selectively activate the water pump upon detecting a presence of water within the drain pan.

8. The system of claim 7, further comprising:

a float that is connected to the primary overflow detection switch by an actuator arm.

9. The system of claim 8, wherein a movement of the float and actuator arm cause the primary overflow detection switch to selectively activate the water pump.

10. The system of claim 1, wherein the secondary overflow detection switch is positioned within the pump assembly main body.

11. The system of claim 10, wherein the secondary overflow detection switch includes functionality for communicating with an auxiliary controller of the air handling unit.

12. The system of claim 11, wherein the secondary overflow detection switch is configured to selectively deactivate the air handling unit upon detecting a presence of water within the drain pan.

13. The system of claim 12, wherein the secondary overflow detection switch includes a solid state liquid detection switch.

14. The system of claim 1, wherein the pump assembly is removably connected to the drain pan.

15. The system of claim 14, further comprising: at least one magnet that removably connects the pump assembly to the drain pan.

* * * * *